US011506004B2

(12) United States Patent
Gutarov et al.

(10) Patent No.: US 11,506,004 B2
(45) Date of Patent: Nov. 22, 2022

(54) AUTOMATIC DRILLING ACTIVITY DETECTION

(71) Applicant: Schlumberger Technology Corporation, Sugar Land, TX (US)

(72) Inventors: Pavel Gutarov, Vailhauques (FR); Matthew Spotkaeff, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1009 days.

(21) Appl. No.: 16/311,153

(22) PCT Filed: Jun. 23, 2016

(86) PCT No.: PCT/IB2016/001165
§ 371 (c)(1),
(2) Date: Dec. 18, 2018

(87) PCT Pub. No.: WO2017/221046
PCT Pub. Date: Dec. 28, 2017

(65) Prior Publication Data

US 2019/0264516 A1 Aug. 29, 2019

(51) Int. Cl.
*E21B 19/20* (2006.01)
*E21B 19/16* (2006.01)
(Continued)

(52) U.S. Cl.
CPC ..... *E21B 19/165* (2013.01); *E21B 19/20* (2013.01); *E21B 44/00* (2013.01); *E21B 44/005* (2013.01); *E21B 45/00* (2013.01); *E21B 47/04* (2013.01)

(58) Field of Classification Search
CPC ..... E21B 19/165; E21B 19/20; E21B 44/005; E21B 44/00; E21B 45/00; E21B 47/04
See application file for complete search history.

(56) References Cited

U.S. PATENT DOCUMENTS 4,545,017 A 10/1985 Richardson
4,549,431 A 10/1985 Soeiinah
(Continued)

FOREIGN PATENT DOCUMENTS

CN 110674841 A 1/2020
EP 0422706 A2 4/1991
(Continued)

OTHER PUBLICATIONS

Lesage et al., A New Approach to Rig Sensors, Feb. 27-Mar. 1990, 1990 IADC/SPE Drilling Conference, Houston, Texas, pp. 723-732 (Year: 1990).*

(Continued)

*Primary Examiner* — Toan M Le
(74) *Attorney, Agent, or Firm* — Alec J. McGinn

(57) ABSTRACT

A method of determining a drilling activity includes receiving a set of measurements at different times. The set of measurements includes a depth of a wellbore, a depth of a drill bit, and a position of a travelling block. The method also includes identifying a connection by determining when the position of the travelling block changes but the depth of the drill bit does not change. The method also includes determining when the depth of the wellbore does not increase between two different connections. The method also includes determining a direction that the drill bit moves between the two connections.

20 Claims, 7 Drawing Sheets

(51) Int. Cl.

| | |
|---|---|
| ***E21B 44/00*** | (2006.01) |
| ***E21B 45/00*** | (2006.01) |
| ***E21B 47/04*** | (2012.01) |

(56) References Cited

U.S. PATENT DOCUMENTS

| | | | |
|---|---|---|---|
| 5,107,705 | A | 4/1992 | Wraight et al. |
| 6,174,001 | B1 | 1/2001 | Enderle |
| 2004/0040746 | A1 | 3/2004 | Niedermayr et al. |
| 2004/0124012 | A1 | 7/2004 | Dunlop et al. |
| 2005/0087367 | A1 | 4/2005 | Hutchinson |
| 2016/0290073 | A1 | 10/2016 | Zheng et al. |
| 2018/0003024 | A1 | 1/2018 | Khare |
| 2018/0238162 | A1 | 8/2018 | Jeffryes |
| 2019/0024493 | A1 | 1/2019 | Johnson et al. |
| 2019/0338635 | A1 | 11/2019 | Orban et al. |

FOREIGN PATENT DOCUMENTS

| | | | |
|---|---|---|---|
| EP | 3504400 | A1 | 7/2019 |
| GB | 2496523 | A | 5/2013 |
| WO | 2019005908 | A1 | 1/2019 |
| WO | 2020191360 | A1 | 9/2020 |

OTHER PUBLICATIONS 2.3 Clustering—scikit-learn 0.23.2 documentation accessed at https://scikit-learn.org/stable/modules/clustering.html#k-means, accessed on Dec. 3, 2020, 22 pages.

Zhao et al., "Automatic Slip Status and Stand Detection in Real-Time Drilling," Offshore Technology Conference, Houston, Texas, USA, May 6-9, 2019, OTC-29372-MS, 14 pages.

Lasseter, T., Karakas, M., and Schweitzer, "Interpreting an RFT-Measured Pulse Test with a Three-Dimensional Simulator," J., SPE 14878, Mar. 1988.

Bunn, G.F., and Yaxley, L.M., "Design, Implementation, and Interpretation of a Three-Dimensional Well Test in the Cormorant Field, North Sea," SPE 15858, Oct. 1986.

Saeedi, J., and Standen, E., "Layer Pulse Testing Using a Wireline Formation Tester," SPE 16803, Sep. 1987.

Bunn, G.F., Wittman, M.J., Morgan, W.D., and Curnutt, R.C., "Distributed Pressure Measurements Allow Early Quantification of Reservoir Dynamics in the Jene Field," SPE 17682, Mar. 1991.

Yaxley, L.M. , and Blaymires, J. M., "A Field Example of Interference Testing Across a Partially Communicating Fault," SPE 19306, 1989.

Kaneda, R., Saeedi, J., and Ayestaran, L.C., "Interpretation of a Pulse Test in a Layered Reservoir," SPE 21337, Dec. 1991.

Examination report for the related GB patent application No. 2496523 dated Feb. 11, 2013.

International Search Report and Written Opinion for the equivalent International patent application PCT/IB2016/001165 dated Mar. 17, 2017.

International Preliminary Report on Patentability for the equivalent International patent application PCT/IB2016/001165 dated Jan. 3, 2019.

International Search Report and Written Opinion of International patent application PCT/US2021/072647 dated Mar. 25, 2022, 12 pages.

* cited by examiner

500

AUTOMATIC DRILLING ACTIVITY DETECTION

BACKGROUND

To increase a length of a drill string, the drill string may be disconnected from a drilling device (e.g., a top drive) and gripped by a slips assembly at the surface to support the drill string. With the drill string supported, another segment (referred to as a drill pipe) may be added to the upper end of the drill string to increase the length of the drill string for deeper drilling. After the increased drill string has been reconnected back to the drilling device, the slips assembly may then release the drill string, and a bottom-hole assembly, which is coupled to a lowermost segment of the drill string, may resume drilling. After the bottom-hole assembly advances the length of the wellbore by the length of the additional segment, the drilling process may be stopped, the drill string is again gripped by the slips assembly, disconnected from the drilling device, and another segment added to the drill string. This is repeated over and over to drill deeper and deeper.

Oftentimes, the overall weight carried by the drilling device (called the "hook load") is monitored to determine when the drill string is gripped by the slips assembly. As used herein, "hook load" refers to a total force pulling down on the hook, supporting the drilling device, at the surface. This force includes the weight of the drill string and any downhole tools (e.g., the bottom-hole assembly) coupled to the drill string, reduced by any force that lessens the weight, such as friction along the wellbore wall and buoyant forces caused by the immersion in drilling fluid. The hook load may or may not include the weight of the drilling device. When the hook load decreases by a relatively large amount, the user may determine that the drill string is in the slips assembly. However, occasionally, the hook load measurements include noise (e.g., spikes) that may adversely affect calculations of non-productive time ("NPT"), invisible loss time ("ILT"), and the like.

SUMMARY

A method of determining a drilling activity is disclosed. The method includes receiving a set of measurements at different times. The set of measurements includes a depth of a wellbore, a depth of a drill bit, and a position of a travelling block. The method also includes identifying a connection by determining when the position of the travelling block changes but the depth of the drill bit does not change. The method also includes determining when the depth of the wellbore does not increase between two different connections. The method also includes determining a direction that the drill bit moves between the two connections.

A computer readable medium is also disclosed. The medium stores instructions thereon that, when executed by a processor, cause the processor to perform operations. The operations include receiving a set of measurements different times. The set of measurements includes a depth of a wellbore, a depth of a drill bit, and a position of a travelling block. The operations also include identifying a connection by determining when the position of the travelling block changes but the depth of the drill bit does not change. The operations also include determining when the depth of the wellbore increases between two different connections. The operations also include determining when the depth of the wellbore does not increase between two consecutive sets of measurements that occur between the two connections.

A computing system is also disclosed. The computing system includes a processor and a memory system. The memory system includes a non-transitory computer readable medium storing instructions thereon that, when executed by the processor, causes cause the computing system to perform operations. The operations include receiving a set of measurements at different times. The set of measurements includes a depth of a wellbore, a depth of a drill bit, and a position of a travelling block. The operations also include identifying a connection by determining when the position of the travelling block changes but the depth of the drill bit does not change. The operations further include determining whether the depth of the wellbore increases between two different connections. If the depth of the wellbore increases between two different connections, the operations include determining whether the depth of the wellbore increases between two consecutive sets of measurements that occur between the two connections. However, if the depth of the wellbore does not increase between the two consecutive sets of measurements, the operations include determining whether a time interval between the two consecutive sets of measurements is between two time intervals where drilling occurs.

The foregoing summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Figure 1:
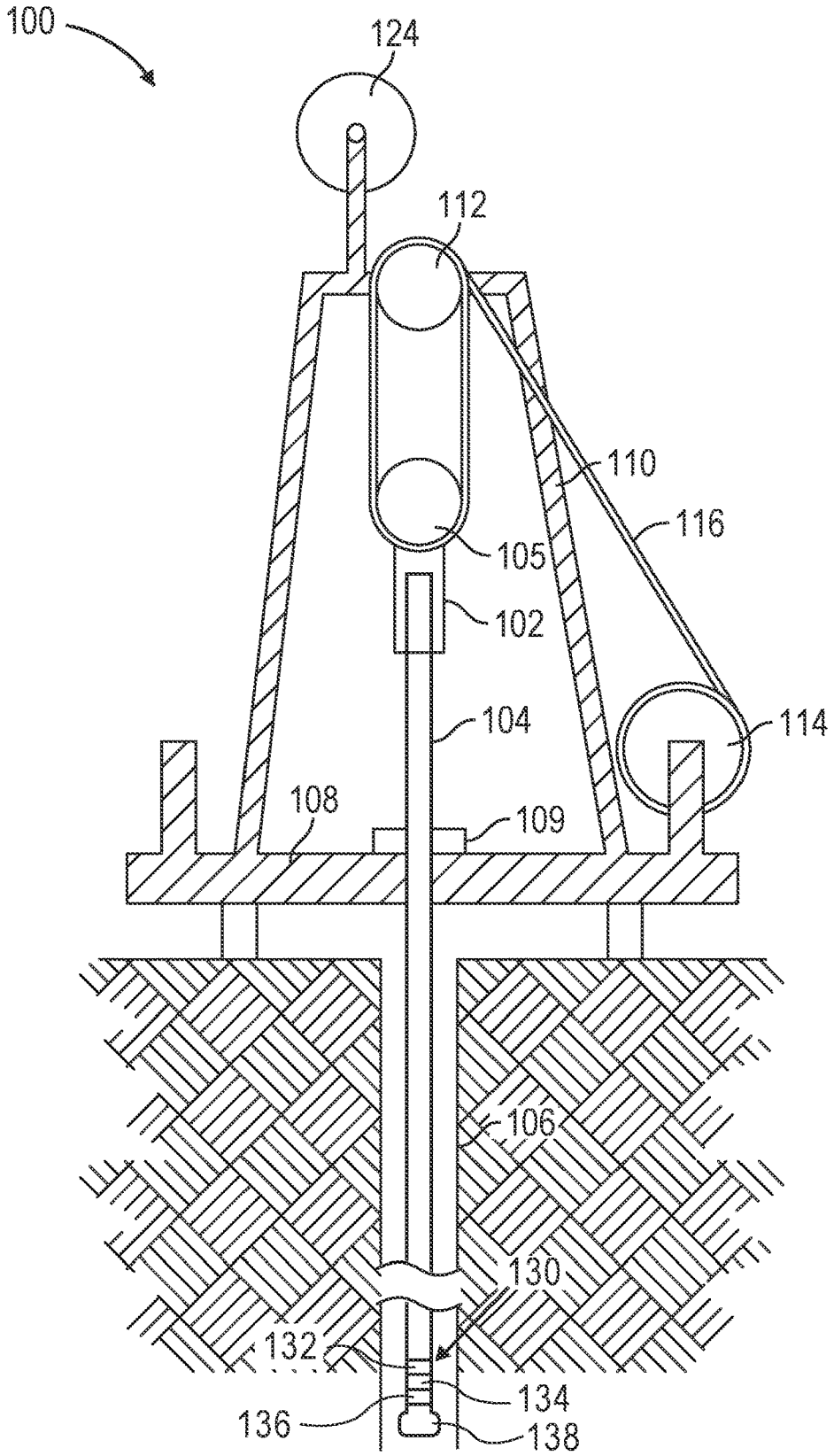
FIG. 1 illustrates a schematic view of a drilling rig, according to an embodiment.

The following detailed description refers to the accompanying drawings. Wherever convenient, the same reference numbers are used in the drawings and the following description to refer to the same or similar parts. While several embodiments and features of the present disclosure are described herein, modifications, adaptations, and other implementations are possible, without departing from the spirit and scope of the present disclosure.

FIG. 1 illustrates a schematic view of a drilling rig 100, according to an embodiment. The drilling rig 100 includes a drilling apparatus 102 and a drill string 104 coupled thereto. The drilling apparatus 102 may include any type of drilling device, such as a top drive, a rotary table, or any other device configured to support, lower, and rotate the drill string 104, which may be deployed into a wellbore 106. In the illustrated embodiment, the drilling apparatus 102 may also include a travelling block 105, which may include one or more rotating sheaves.

The drilling rig 100 may also include a rig floor 108, from which a support structure (e.g., including a mast) 110 may extend. A slips assembly 109 may be disposed at the rig floor 108, and may be configured to engage the drill string 104 so as to enable additional segments to be added to, or removed from, the drill string 104 via the drilling apparatus 102. More particularly, the slips assembly 109 may be used to grip the drill string 104 and suspend it in the drilling apparatus 102. The slips assembly 109 may include three or more metallic wedges that are hinged together, forming a near circle around the drill string 104. The inner surface of the slips assembly 109 may include replaceable, metallic teeth that embed slightly into the side of the drill string 104. The outer surface of the slips assembly 109 may be tapered to match the taper of the drilling apparatus 102. Once the slips assembly 109 is in place around the drill string 104, the driller may slowly lower the drill string 104. As the drill string 104 descends, the teeth on the inside of the slips assembly 109 grip the drill string 104, and the slips assembly 109 is pulled downward. This downward force causes the wedges to provide a radially-inward compressive force on the drill string 104. With the drill string 104 suspended in the slips assembly 109, the rig crew may then add (e.g., screw) a new stand of drill pipe to the upper end of the drill string 104 to increase the length of the drill string 104. During tripping out operations, with the drill string 104 suspended in the slips assembly 109, the rig crew may remove the uppermost segment of the drill string 104 to decrease the length of the drill string 104. The driller may then raise the drill string 104 to unlock the gripping action of the slips assembly 109.

A crown block 112 may be coupled to the support structure 110. Further, a drawworks 114 may be coupled to the rig floor 108. A drill line 116 may extend between the drawworks 114 and the crown block 112, and may be received through the sheaves of the travelling block 105. Accordingly, the position of the drilling apparatus 102 may be changed (e.g., raised or lowered) by spooling or unspooling the drilling line 116 from the drawworks 114 (e.g., by rotation of the drawworks 114).

A downhole tool 130 may be coupled to the drill string 104. In one embodiment, the downhole tool 130 may be or include a bottom-hole assembly. The downhole tool 130 may include a measurement-while drilling ("MWD") tool 132, a logging-while-drilling ("LWD") tool 134, a rotary-steerable tool 136, and a drill bit 138.

Figure 2A:
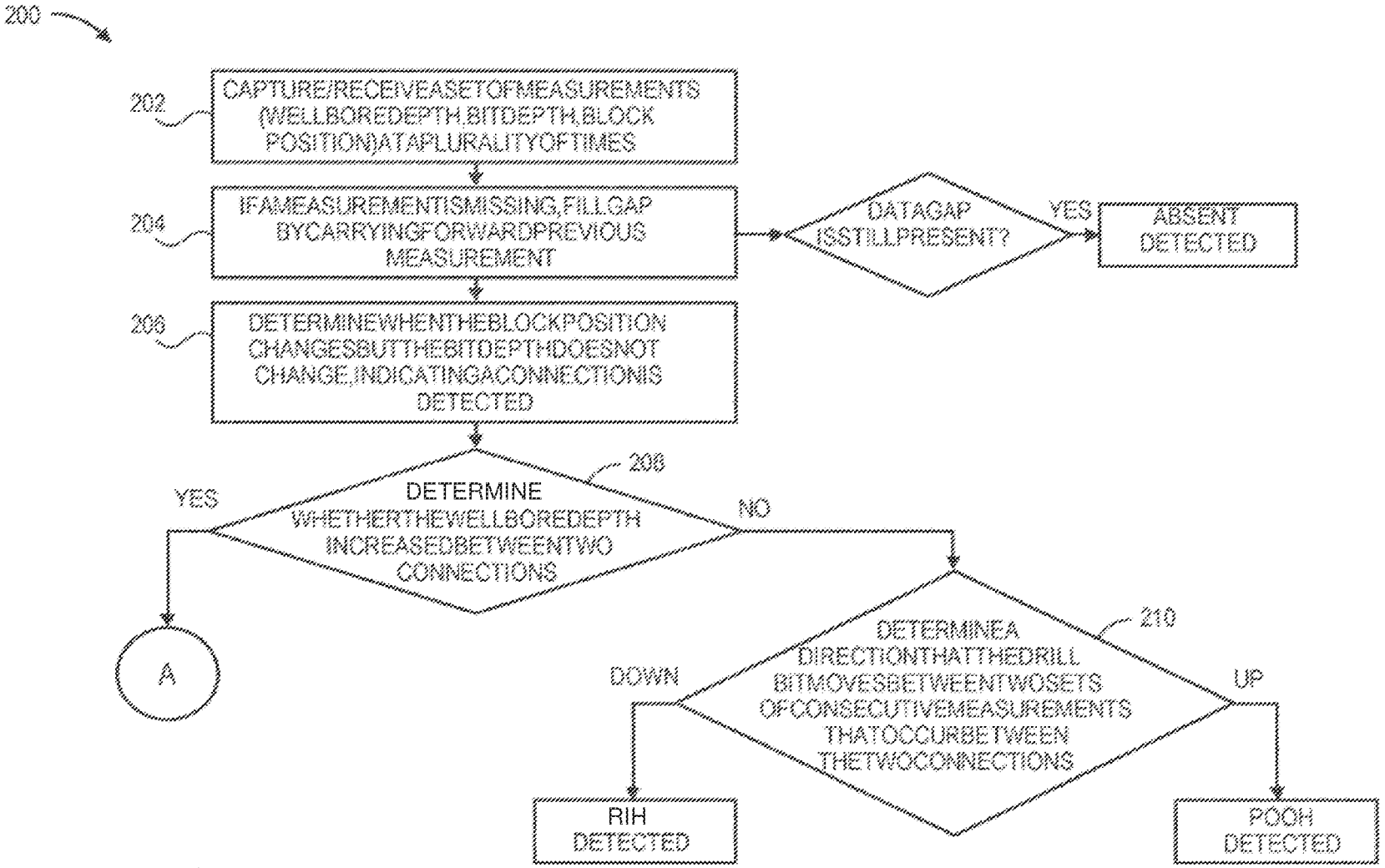
FIG. 2 illustrates a flowchart of a method for determining a drilling activity, according to an embodiment.
Figure 2B:
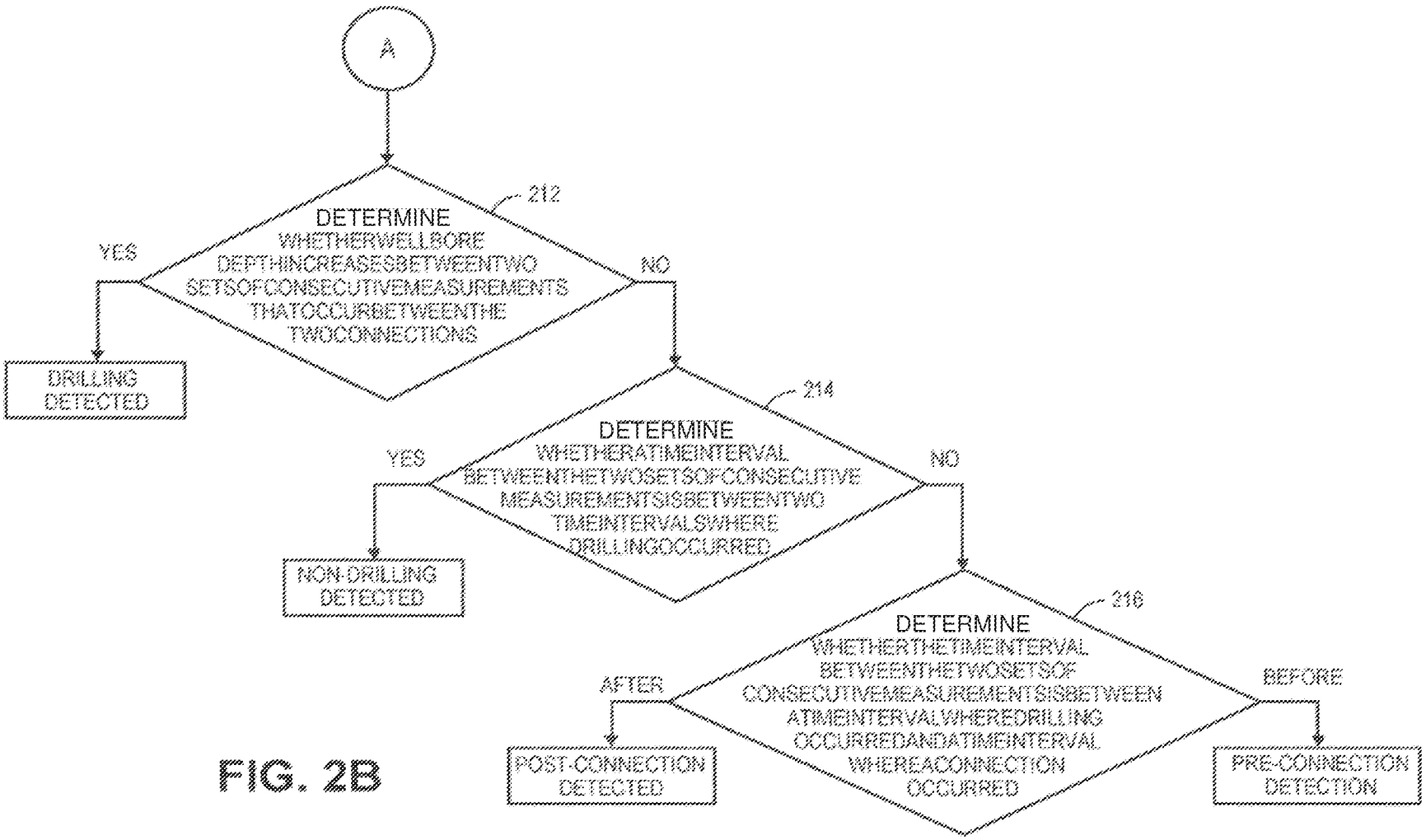

FIG. 2 illustrates a flowchart of a method 200 for determining a drilling activity, according to an embodiment. The drilling activity may include one or more of the following:

- Drilling: The downhole tool 130 (e.g., the drill bit 138) is drilling to increase the depth of the wellbore 106.
- Non-drilling: Non-drilling activity is occurring. A non-drilling related activity is determined to be occurring when none of the other drilling activities (i.e., drilling, run-in-hole, pulled-out-of-hole, pre-connection, connection, post connection) is/are occurring, but the end of the current drill stand has not yet been reached. During non-drilling, the flow rate of fluid being pumped into the drill string 104 may increase and/or decrease, the rate of rotation of the drill string 104 may increase and/or decrease, the downhole tool 130 (e.g., the drill bit 138) may move upwards and/or downwards, or any combination thereof. In one example, a non-drilling activity may be or include a time when the drill bit 138 is idle (e.g., not drilling) and the slips assembly 109 is not engaged with the drill string 104.
- Run-in-hole ("RIH"): The drill string 104 and the downhole tool 130 are being run into the wellbore 106.
- Pulled-out-of-hole ("POOH"): The drill string 104 and the downhole tool 130 are being pulled out of the wellbore 106.
- Pre-connection: The downhole tool 130 (e.g., the drill bit 138) has completed drilling operations for the current section of drill pipe, but the slips assembly 109 has not begun to move (e.g., radially-inward) into engagement with the drill string 104. During pre-connection, the flow rate of fluid being pumped into the drill string 104 may increase and/or decrease, the rate of rotation of the drill string 104 may increase and/or decrease, the downhole tool 130 (e.g., the drill bit 138) may move upwards and/or downwards, or any combination thereof.
- Connection: The slips assembly 109 is engaged with, and supports, the drill string 104 (i.e., the drill string 104 is "in-slips"). When a connection is occurring, a segment may be added to the drill string 104 to increase the length of the drill string 104, or a segment may be removed from the drill string 104 to reduce the length of the drill string 104.
- Post-connection: The drill string 104 is released by the slips assembly 109, and the downhole tool 130 (e.g., the drill bit 138) are lowered to be on-bottom. During post-connection, the flow rate of fluid being pumped into the drill string 104 may increase/and/or decrease, the rate of rotation of the drill string 104 may increase and/or decrease, the downhole tool 130 (e.g., the drill bit 138) may move upwards and/or downwards, or any combination thereof.
- Absent: No data is received (e.g., at least one of the inputs is missing).

In at least one embodiment, the method 200 may also be used to determine a slips status. The slips status may include one or more of the following:

- In-slips: The slips assembly 109 is engaged with, and supports, the drill string 104 (i.e., the drill string 104 is "in-slips").
- Out-of-slips: The slips assembly 109 is not engaged with, and does not support, the drill string 104.
- Absent: No data is received (e.g., at least one of the inputs is missing).

The method 200 may begin by capturing/receiving a set of measurements at a plurality of different times, as at 202. The set of measurements may include (1) a depth of the wellbore 106, (2) a depth of the drill bit 138, (3) a position of the travelling block 105, or a combination thereof. The set of measurements may not include the weight on the hook (i.e., "hook load"), or the weight on the drill bit 138 (i.e., "WOB"). Each set of measurements may be captured/received a predetermined amount of time after the previous set of measurements is captured/received. The predetermined amount of time may be, for example, about three seconds; however, as will be appreciated, the predetermined amount of time may be shorter or longer.

The depth of the wellbore 106 may be measured when the drill bit 138 is "on-bottom." In one example, the depth of the wellbore 106 may be measured by adding (1) the length of the drill string 104 that is below the surface, (2) the length of the downhole tool 130, and (3) the length(s) of any other components (e.g., joints, subs, etc.) that are below the surface. In another example, the depth of the wellbore 106 may be measured by a sensor in the downhole tool 130.

The depth of the drill bit 138 may be measured by when the drill bit 138 is "on-bottom" or "off-bottom." When the drill bit 138 is on-bottom, the depth of the drill bit 138 may be the same as the depth of the wellbore 106. When the drill bit 138 is off-bottom, the depth of the drill bit 138 may be less than the depth of the wellbore 106. In one example, the depth of the drill bit 138 may be measured by adding (1) the length of the drill string 104 that is below the surface, (2) the length of the downhole tool 130, and (3) the length(s) of any other components (e.g., joints, subs, etc.) that are below the surface. In another example, the depth of the drill bit 138 may be measured by a sensor in the downhole tool 130. The position of the travelling block 105 may be measured by an encoder in the drawworks 114, or using any other suitable device or technique.

The method 200 may also include filling a gap in one of the measurements (e.g., the depth of the wellbore 106, the depth of the drill bit 138, and/or the position of the travelling block 105) by carrying forward a measurement taken at the previous time, as at 204. For example, if the set of measurements does not include the depth of the wellbore 106 at time $T_n$, the depth of the wellbore 106 at the previous time (e.g., time $T_{n-1}$) may be carried forward (i.e., copied and pasted) to the depth of the wellbore 106 at time $T_n$.

If, after 204, the gap in the measurements is still present at time $T_n$, the drilling activity "absent" may be recorded in place of the measurement. For example, if the depth of the wellbore 106 was also not measured/recorded at time $T_0$, the value of "absent" may be recorded for the depth of the wellbore 106 at time $T_n$.

The method 200 may also include determining whether the position of the travelling block 105 changes but the depth of the drill bit 138 does not change between two consecutive sets of measurements, as at 206. When the position of the travelling block 105 changes but the depth of the drill bit 138 does not change, a "connection" may be recorded during the time interval between the two consecutive sets of measurements, indicating that the drill string 104 is in-slips.

The method 200 may also include determining whether the depth of the wellbore 106 increases between two different connections, as at 208. As used herein, two connections are different when another drilling activity (e.g., drilling, RIH, POOH) occurs between the two connections. As a result, the time interval between the two connections may be greater than the time interval between a consecutive set of measurements. For example, the time interval between the two connections may be from about 4 minutes to about 10 minutes, from about 10 minutes to about 20 minutes, from about 20 minutes, to about 30 minutes, or more.

If the depth of the wellbore 106 does not increase between the two connections, a non-drilling section may be detected. As used herein, a "non-drilling section" refers to a period of time between two connections in which no increase in the depth of the wellbore 106 has occurred. When this occurs, the method 200 may include determining a direction that the drill string 104 and/or the downhole tool 130 (e.g., the drill bit 138) move(s) between two consecutive sets of measurements that occur between the two connections, as at 210. For example, if the drill string 104 and/or the downhole tool 130 move downward, it may be determined that the drill string 104 and the downhole tool 130 are being run-in-hole ("RIH") between the two consecutive sets of measurements that occur between the two connections, and if the drill string 104 and/or the downhole tool 130 move upward, it may be determined that the drill string 104 and the downhole tool 130 are being pulled out-of-hole ("POOH") between the two consecutive sets of measurements that occur between the two connections.

If the depth of the wellbore 106 does increase between the two connections, a drilling section may be detected. As used herein, a "drilling section" refers to any period between two connections in which the depth of the wellbore 106 has increased. When this occurs, the method 200 may include determining whether the depth of the wellbore 106 increases between two consecutive sets of measurements that occur between the two connections, as at 212. If the depth of the wellbore 106 does increase between the two consecutive sets of measurements that occur between the two connections, it may be determined that the downhole tool 130 (e.g., the drill bit 138) is drilling in the time interval between the two consecutive sets of measurements.

If the depth of the wellbore 106 does not increase between two the consecutive sets of measurements that occur between the two connections, the method 200 may include determining whether a time interval between the two consecutive sets of measurements is between two time intervals where drilling occurred, as at 214. If the time interval between the two consecutive sets of measurements that occur between the two connections is between two time intervals where drilling occurred, then it may be determined that the downhole tool 130 (e.g., the drill bit 138) is not drilling (i.e., the drilling activity is "non-drilling").

If the time interval between the two consecutive sets of measurements that occur between the two connections is not between two time intervals where drilling occurred, the method 200 may include determining whether the time interval between the two consecutive sets of measurements is between a time interval where one of the two connections occurred and a time interval where drilling occurred, as at 216. If the time interval between the two consecutive sets of measurements is after a time interval where drilling occurred and before a time interval where a connection occurred, then the time interval between the two consecutive sets of measurements is determined to be a pre-connection interval. If the time interval between the two consecutive sets of measurements is after a time interval where one of the two connections occurred and before a time interval where drilling occurred, then the time interval between the two consecutive sets of measurements is determined to be a post-connection interval.

Thus, the method 200 may be used to determine drilling connection intervals by looking at (1) a depth of the wellbore 106, (2) a depth of the drill bit 138, (3) a position of the travelling block 105, or a combination thereof, and without looking at hook load or WOB. In this case, noisy data that is often associated with the hook load measurement, or low threshold data recorded at the beginning of the wellbore (e.g., due to a low relative change in weight when the overall length of drill pipe is low) may be ignored.

Figure 3:
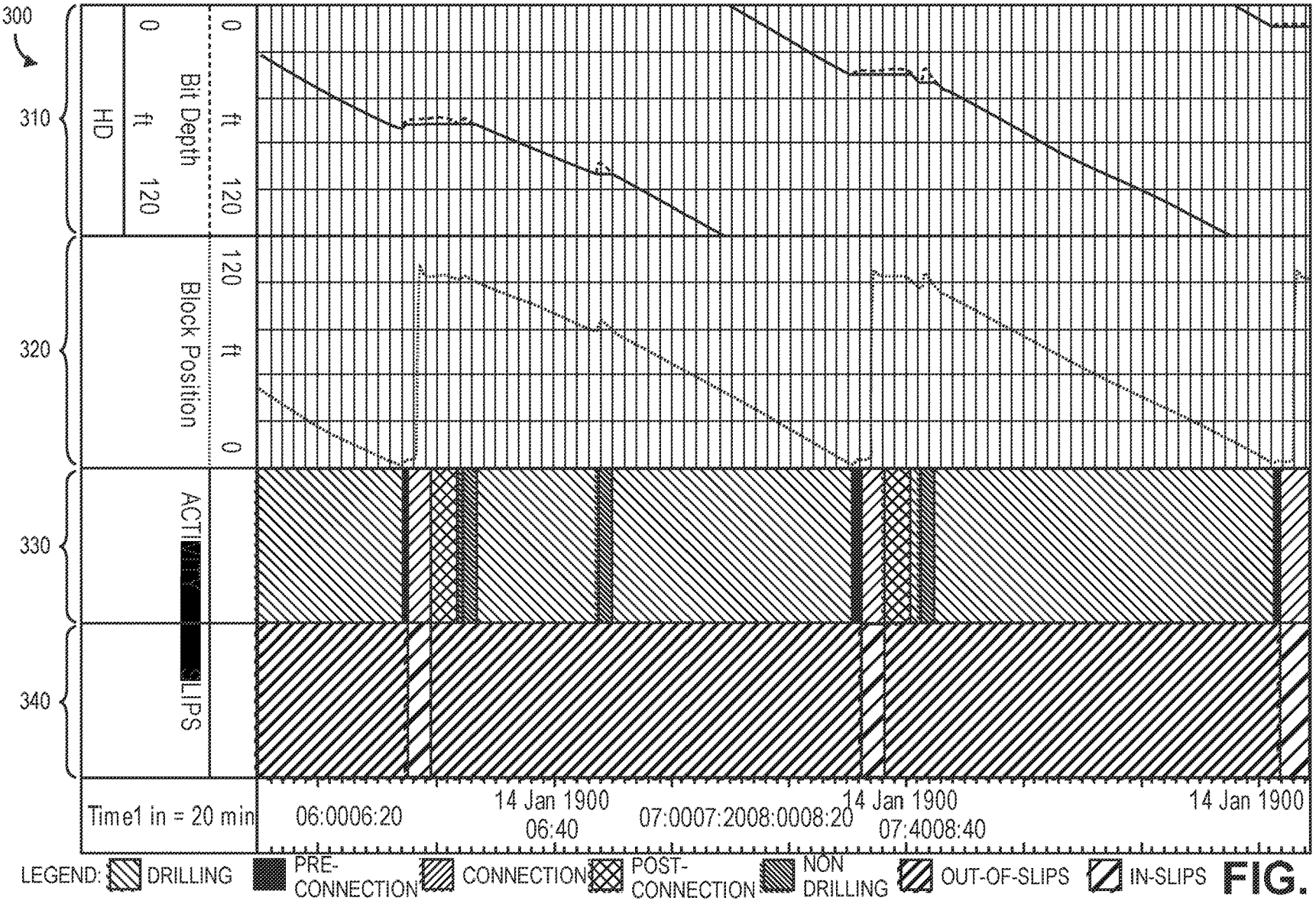
FIG. 3 illustrates a graph showing time intervals including drilling, pre-connection, connection, post-connection, and non-drilling activity, according to an embodiment.

FIG. 3 illustrates a graph 300 showing time intervals including drilling, pre-connection, connection, post-connection, and non-drilling activity, according to an embodiment. The time is shown on the X-axis and totals about 3 hours. A top quarter 310 of the graph 300 shows the depth of the wellbore 106 versus time. The next quarter 320 of the graph 300 shows the position of the travelling block 105 versus time. The next quarter 330 of the graph 300 shows time intervals where the downhole tool 130 (e.g., the drill bit 138) is drilling, where a pre-connection occurs, where connection occurs, where post-connection occurs, and where non-drilling activity occurs. The bottom quarter 340 of the graph 300 shows the time intervals where the drill string 104 is engaged with, and supported by, the slips assembly 109 (i.e., in-slips) and where the drill string 104 is not engaged with, or supported by, the slips assembly 109 (i.e., out-of-slips). As may be seen, the travelling block 105 moves upward during a connection and downward during drilling. In addition, the drill string 104 is in-slips when a connection is occurring and out-of-slips when a connection is not occurring.

Figure 4:
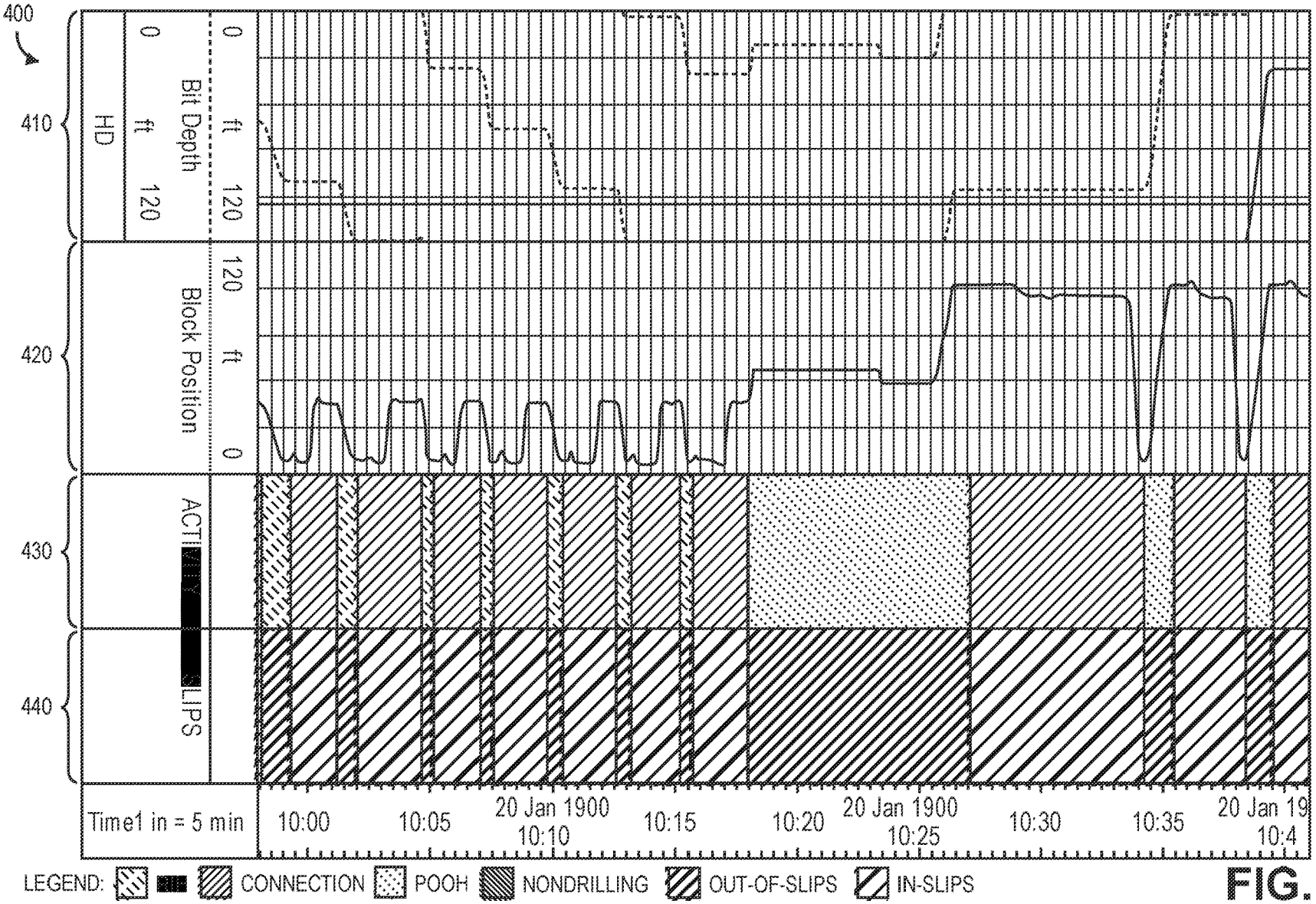
FIG. 4 illustrates a graph showing time intervals where the drill string and downhole tool are run into the wellbore ("RIH") and pulled out of the wellbore ("POOH"), according to an embodiment.

FIG. 4 illustrates a graph 400 showing time intervals where the downhole tool 130 is run into the wellbore 106 ("RIH") and pulled out of the wellbore 106 ("POOH"), according to an embodiment. The time is shown on the X-axis and totals about 40 minutes. A top quarter 410 of the graph 400 shows the depth of the wellbore 106 versus time. The next quarter 420 of the graph 400 shows the position of the travelling block 105 versus time. The next quarter 430 of the graph 400 shows time intervals where the drill string 104 and downhole tool 130 are run into the wellbore 106, where a connection occurs, and where the drill string 104 and downhole tool 130 are pulled out of the wellbore 106. The bottom quarter 440 of the graph 400 shows the time intervals where the drill string 104 is engaged with, and supported by, the slips assembly 109 (i.e., in-slips) and where the drill string 104 is not engaged with, or supported by, the slips assembly 109 (i.e., out-of-slips). As may be seen, the depth of the drill bit 138 increases when the downhole tool 130 is run into the wellbore 106, remains constant during a connection, and decreases when the downhole tool 130 is pulled out of the wellbore 106. The travelling block 105 moves downward when the downhole tool 130 is run into the wellbore 106, remains constant during a connection, and moves upward when the downhole tool 130 is pulled out of the wellbore 106. The drill string 104 is in-slips when a connection is occurring and out-of-slips when the drill string 104 and downhole tool 130 are run into the wellbore 106 and pulled out of the wellbore 106.

Figure 5:
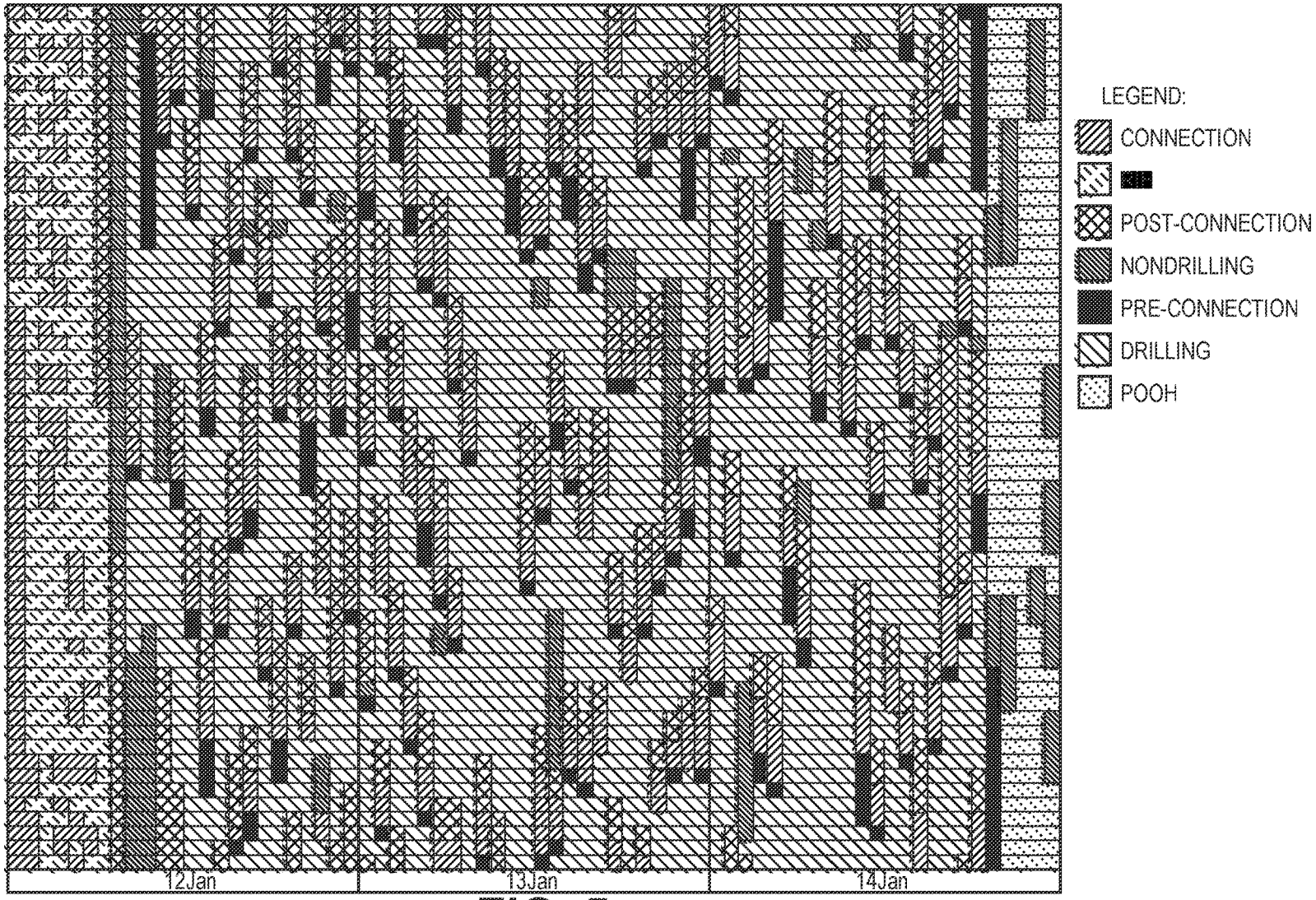
FIG. 5 illustrates a graph showing time intervals including when the drill string and downhole tool are run into the wellbore, when pre-connections occur, when connections occur, when post-connections occur, when the downhole tool (e.g., the drill bit) is drilling, when the downhole tool (e.g., the drill bit) is not drilling, and when the drill string and downhole tool are pulled out of the wellbore, according to an embodiment.

FIG. 5 illustrates a graph 500 showing time intervals including when the drill string 104 and downhole tool 130 are run into the wellbore 106, when pre-connections occur, when connections occur, when post-connections occur, when the downhole tool (e.g., the drill bit 138) is drilling, when the downhole tool 130 (e.g., the drill bit 138) is not drilling, and when the downhole tool 130 is pulled out of the wellbore 106, according to an embodiment. The time is shown on the X-axis and totals about 3 days. Vertical columns represent hours, and horizontal rows represent minutes, with time proceeding upward and to the right (i.e., time begins in the lower left-hand corner and concludes in the upper right-hand corner).

As may be seen, the first 6-7 hours include alternating intervals of the drill string 104 and downhole tool 130 being run into the wellbore 106 and connections occurring to add segments to increase the length of the drill string 104. Over approximately the next two days, drilling occurs, followed by a pre-connection, a connection, a post-connection, and more drilling. The last 4-5 hours include alternating intervals of the drill string 104 and downhole tool 130 being pulled out of the wellbore 106 and connections occurring.

Figure 6:
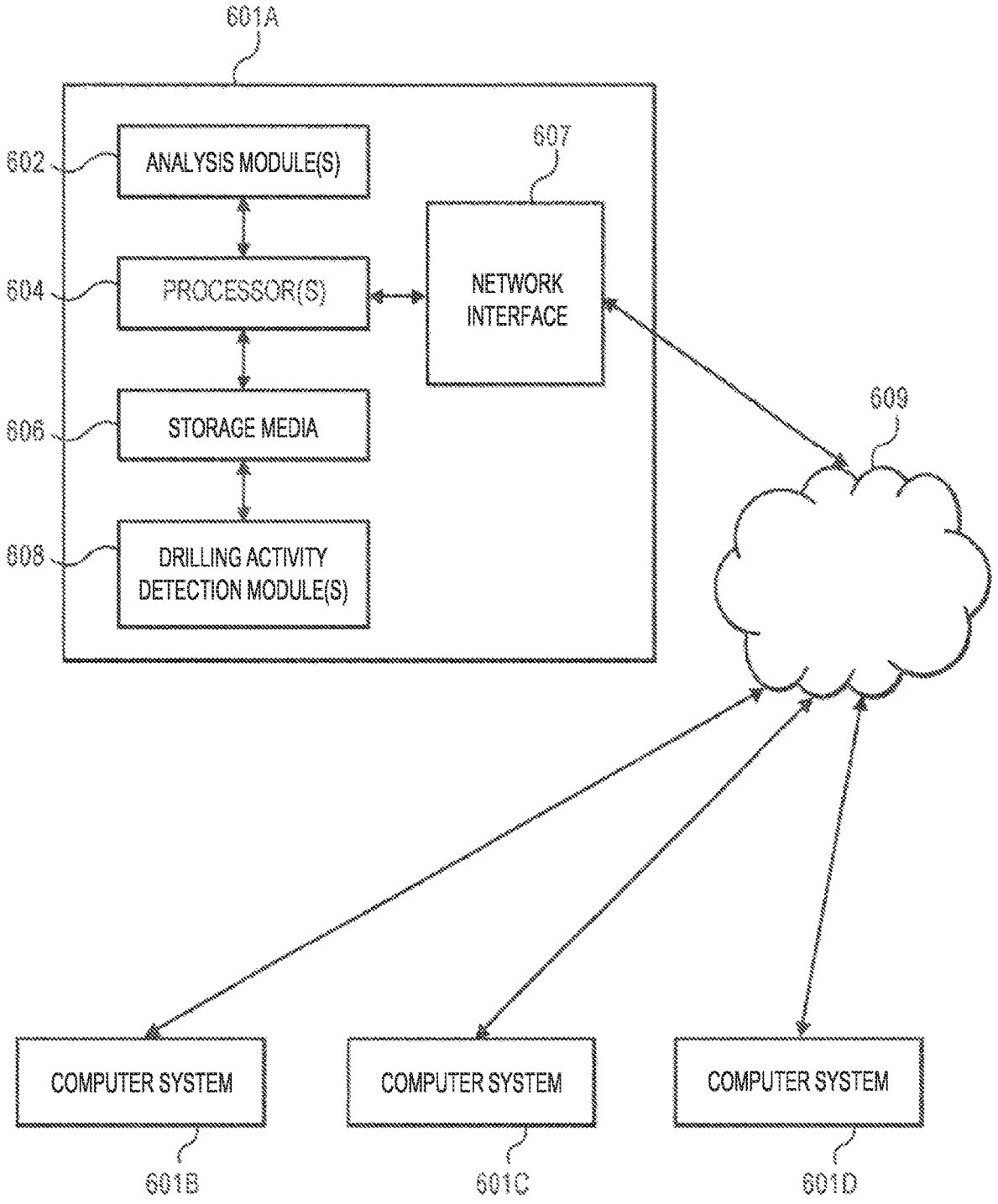
FIG. 6 illustrates a schematic view of a computing system that may perform at least a portion of the method(s) disclosed herein, according to an embodiment.

In some embodiments, the methods of the present disclosure may be executed by a computing system. FIG. 6 illustrates an example of such a computing system 600, in accordance with some embodiments. The computing system 600 may include a computer or computer system 601A, which may be an individual computer system 601A or an arrangement of distributed computer systems. The computer system 601A includes one or more analysis modules 602 that are configured to perform various tasks according to some embodiments, such as one or more methods disclosed herein. To perform these various tasks, the analysis module 602 executes independently, or in coordination with, one or more processors 604, which is (or are) connected to one or more storage media 606. The processor(s) 604 is (or are) also connected to a network interface 607 to allow the computer system 601A to communicate over a data network 609 with one or more additional computer systems and/or computing systems, such as 601B, 601C, and/or 601D (note that computer systems 601B, 601C and/or 601D may or may not share the same architecture as computer system 601A, and may be located in different physical locations, e.g., computer systems 601A and 601B may be located in a processing facility, while in communication with one or more computer systems such as 601C and/or 601D that are located in one or more data centers, and/or located in varying countries on different continents).

A processor may include a microprocessor, microcontroller, processor module or subsystem, programmable integrated circuit, programmable gate array, or another control or computing device.

The storage media 606 may be implemented as one or more computer-readable or machine-readable storage media. Note that while in the example embodiment of FIG. 6 storage media 606 is depicted as within computer system 601A, in some embodiments, storage media 606 may be distributed within and/or across multiple internal and/or external enclosures of computing system 601A and/or additional computing systems. Storage media 606 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 600 may include one or more drilling activity detection module(s) 608. The drilling activity detection module(s) 608 may be used to perform at least a portion of the method 200. More particularly, the drilling activity detection module(s) 608 may receive the sets of measurements and determine the drilling activity, the slips activity, or both.

It should be appreciated that computing system 600 is only one example of a computing system, and that computing system 600 may have more or fewer components than shown, may combine additional components not depicted in the example embodiment of FIG. 6, and/or computing system 600 may have a different configuration or arrangement of the components depicted in FIG. 6. The various components shown in FIG. 6 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A method of determining a drilling activity, comprising:

receiving, by a computer, a set of measurements at a plurality of different times, wherein the set of measurements comprises a depth of a wellbore and a depth of a drill bit, both of which being provided to the computer by a sensor in the downhole tool, and a position of a travelling block;

identifying, by the computer, a connection by determining when the position of the travelling block changes and the depth of the drill bit does not change;

detecting drilling activity responsive to the computer determining that the depth of the wellbore increased between two connections, and determining that the depth of the wellbore increased between two sets of consecutive measurements occurring between the two connections;

detecting a post connection in a time interval between the two sets of consecutive measurements responsive to determining that the depth of the wellbore did not increase between the two sets of consecutive measurements occurring between the two connections, determining that the time interval between the two sets of consecutive measurements is not between two time intervals where drilling occurred, and determining that the time interval between the two sets of consecutive measurements is after a time interval where one of the two connections occurred and before a time interval where drilling occurred.

2. The method of claim 1, further comprising determining a direction that the drill bit moves without using measurements of a hook load, a weight on the drill bit, or a combination thereof.

3. The method of claim 1, further comprising determining that a drill string is engaged with, and supported by, a slips assembly when one of the connections occurs.

4. The method of claim 1, further comprising:

responsive to determining that the depth of the wellbore did not increase between the two connections, performing:

detecting that a drill string and a downhole tool are run into the wellbore responsive to determining that the drill bit moves down between the two sets of consecutive measurements that occur between the two connections, and detecting that the drill string and the downhole tool are being pulled out of the wellbore responsive to determining that the drill bit moves up between the two sets of consecutive measurements that occur between the two connections.

5. The method of claim 1, wherein the determining that the depth of the wellbore did not increase between the two sets of consecutive measurements that occur between the two connections is performed without using measurements of a hook load, a weight on the drill bit, or a combination thereof.

6. The method of claim 1, further comprising:

filling a gap in one of a measurement of the depth of the wellbore, a measurement of the depth of the drill bit, and a measurement of the position of the travelling block by carrying forward the one of the measurements from a previous time.

7. The method of claim 1, further comprising determining that the drill bit is drilling without using measurements of a hook load, a weight on the drill bit, or a combination thereof.

8. The method of claim 1, further comprising:

detecting a pre-connection in the time interval between the two sets of consecutive measurements responsive to determining that the depth of the wellbore increased between the two connections, determining that the depth of the wellbore did not increase between the two sets of consecutive measurements occurring between the two connections, determining that the time interval between the two sets of consecutive measurements is not between two time intervals where drilling occurred, and determining that the time interval between the two sets of consecutive measurements is after a time interval where drilling occurred and before a time interval where a connection occurred.

9. A non-transitory computer readable medium storing instructions thereon that, when executed by a processor, are configured to cause the processor to perform operations, the operations comprising:

receiving a set of measurements at a plurality of different times, wherein the set of measurements comprises a depth of a wellbore and a depth of a drill bit, both of which being provided by a sensor in a downhole tool, and a position of a travelling block;

identifying a connection by determining when the position of the travelling block changes but the depth of the drill bit does not change;

detecting drilling activity responsive to determining that the depth of the wellbore increased between two connections, and determining that the depth of the wellbore increased between two sets of consecutive measurements occurring between the two connections, and detecting a pre-connection in a time interval between the two sets of consecutive measurements responsive to determining that the depth of the wellbore did not increase between the two sets of consecutive measurements occurring between the two connections, determining that the time interval between the two sets of consecutive measurements is not between two time intervals where drilling occurred, and determining that the time interval between the two sets of consecutive measurements is after a time interval where drilling occurred and before a time interval where a connection occurred.

10. The non-transitory computer readable medium of claim 9, wherein the determining that the depth of the wellbore did not increase between the two sets of consecutive measurements that occur between the two connections is performed without using measurements of a hook load, a weight on the drill bit, or a combination thereof.

11. The non-transitory computer-readable medium of claim 9, further comprising:

responsive to determining that the depth of the wellbore did not increase between the two connections, performing:

detecting that a drill string and a downhole tool are run into the wellbore responsive to determining that the drill bit moves down between the two sets of consecutive measurements that occur between the two connections, and detecting that the drill string and the downhole tool are being pulled out of the wellbore responsive to determining that the drill bit moves up between the two sets of consecutive measurements that occur between the two connections.

12. The non-transitory computer-readable medium of claim 9, wherein the operations further comprising:

filling a gap in one of a measurement of the depth of the wellbore, a measurement of the depth of the drill bit, and a measurement of the position of the travelling block by carrying forward the one of the measurements from a previous time.

13. The non-transitory computer-readable medium of claim 9, further comprising determining a direction that the drill bit moves without using measurements of a hook load, a weight on the drill bit, or a combination thereof.

14. A computing system, comprising:

a processor; and a memory system comprising one or more non-transitory computer readable media storing instructions thereon that, when executed by the processor, are configured to cause the computing system to perform operations, the operations comprising:

receiving a set of measurements at a plurality of different times, wherein the set of measurements comprises a depth of a wellbore and a depth of a drill bit, both of which being provided by a sensor in a downhole tool, and a position of a travelling block being provided by an encoder;

identifying a connection by determining when the position of the travelling block changes but the depth of the drill bit does not change;

detecting drilling activity responsive to determining that the depth of the wellbore increased between two connections, and determining that the depth of the wellbore increased between two sets of consecutive measurements occurring between the two connections;

detecting a post connection in a time interval between the two sets of consecutive measurements responsive to determining that the depth of the wellbore did not increase between the two sets of consecutive measurements occurring between the two connections, determining that the time interval between the two sets of consecutive measurements is not between two time intervals where drilling occurred, and determining that the time interval between the two sets of consecutive measurements is after a time interval where one of the two connections occurred and before a time interval where drilling occurred; and detecting a pre-connection in the time interval between the two sets of consecutive measurements responsive to determining that the depth of the wellbore did not increase between the two sets of consecutive measurements occurring between the two connections, determining that the time interval between the two sets of consecutive measurements is not between two time intervals where drilling occurred, and determining that the time interval between the two sets of consecutive measurements is after a time interval where drilling occurred and before a time interval where a connection occurred.

15. The computing system of claim 14, wherein the operations further comprise filling a gap in one of a measurement of the depth of the wellbore, a measurement of the depth of the drill bit, and a measurement of the position of the travelling block by carrying forward the one of the measurements from a previous time.

16. The computing system of claim 14, wherein the operations further comprise determining that the drill bit is drilling without using measurements of a hook load, a weight on the drill bit, or a combination thereof.

17. The computing system of claim 14, wherein the detecting the post connection occurred without using measurements of a hook load, a weight on the drill bit, or a combination thereof.

18. The computing system of claim 14, wherein the operations further comprise:

responsive to determining that the depth of the wellbore did not increase between the two connections, performing:

detecting that a drill string and the downhole tool are run into the wellbore responsive to determining that the drill bit moves down between the two sets of consecutive measurements that occur between the two connections, and detecting that the drill string and the downhole tool are being pulled out of the wellbore responsive to determining that the drill bit moves up between the two sets of consecutive measurements that occur between the two connections.

19. The computing system of claim 14, further comprising determining a direction that the drill bit moves without using measurements of a hook load, a weight on bit, or a combination thereof.

20. The computing system of claim 14, further comprising:

detecting non-drilling activity responsive to determining that the depth of the wellbore increased between the two connections, determining that the depth of the wellbore did not increase between the two sets of consecutive measurements occurring between the two connections, and determining that a time interval between the two sets of consecutive measurements is between two time intervals where drilling occurred.

* * * * *